US007759589B2

(12) United States Patent
Göthlin

(10) Patent No.: US 7,759,589 B2
(45) Date of Patent: Jul. 20, 2010

(54) POWER WINDOW SWITCH APPARATUS

(75) Inventor: Jonas Wilhelm Göthlin, Torslanda (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/958,870

(22) Filed: Dec. 18, 2007

(65) Prior Publication Data

US 2008/0149466 A1 Jun. 26, 2008

(30) Foreign Application Priority Data

Dec. 20, 2006 (EP) ..... 06026463

(51) Int. Cl.
*H01H 9/26* (2006.01)

(52) U.S. Cl. ..... 200/5 R; 200/18; 200/538

(58) Field of Classification Search ..... 200/1 B, 200/4, 5 R, 6 A, 6 R, 6 B, 16 R, 17 R, 18, 200/553, 557, 517, 571–572, 339, 519, 538
See application file for complete search history.

(56) References Cited

U.S. PATENT DOCUMENTS

| | | | | |
|---|---|---|---|---|
| 1,684,280 | A * | 9/1928 | Jones | 200/6 C |
| 2,423,387 | A * | 7/1947 | Johnson | 200/519 |
| 2,659,838 | A * | 11/1953 | Du Rocher | 315/77 |
| 3,436,497 | A * | 4/1969 | Mading | 200/16 A |
| 3,567,874 | A * | 3/1971 | Strobel | 200/16 D |
| 4,712,079 | A | 12/1987 | Marquardt | |
| 6,590,169 | B2 * | 7/2003 | Martinez | 200/17 R |
| 6,657,316 | B1 * | 12/2003 | Smith et al. | 307/10.1 |
| 7,060,920 | B2 * | 6/2006 | Serizawa et al. | 200/200 |
| 7,084,360 | B2 * | 8/2006 | Schmidt et al. | 200/5 R |
| 7,265,306 | B2 * | 9/2007 | Radu | 200/310 |
| 7,268,305 | B2 * | 9/2007 | Schmidt et al. | 200/5 R |
| 7,294,800 | B2 * | 11/2007 | Koyama | 200/302.1 |
| 7,297,884 | B2 * | 11/2007 | Shimizu | 200/5 R |
| 7,439,460 | B1 * | 10/2008 | Watson | 200/5 R |
| 7,476,818 | B2 * | 1/2009 | Nam | 200/5 R |
| 7,504,601 | B2 * | 3/2009 | Belmond et al. | 200/61.62 |
| 2005/0045455 | A1 | 3/2005 | McGuffin-Noll | |
| 2006/0131140 | A1 | 6/2006 | Oh | |

FOREIGN PATENT DOCUMENTS

| | | |
|---|---|---|
| DE | 31 17 783 A1 | 11/1982 |
| EP | 0 957 498 A2 | 11/1999 |

* cited by examiner

*Primary Examiner*—Renee S Luebke
*Assistant Examiner*—Lisa Klaus
(74) *Attorney, Agent, or Firm*—Frank A. MacKenzie; Brooks Kushman P.C.

(57) ABSTRACT

The present invention relates to a power window switch apparatus (1) having a switch housing (5) supporting at least one actuation element (2) for user access at a first surface (4) of the switch housing (5). The actuation element (2) is arranged to be slideable from a zero position in directions perpendicular to the first surface (4). The actuation element (2) being operable upon user manipulation to slide in a first direction outwards of the housing (5) for closing of an associated first switch element (8) for energizing an associated motor for lift of an associated window. The actuation element (2) being operable upon user manipulation to slide in a second direction, opposite to the first direction, for closing of an associated second switch element (9) for energizing the associated motor for lowering the associated window.

5 Claims, 2 Drawing Sheets

POWER WINDOW SWITCH APPARATUS

TECHNICAL FIELD

The present invention is related to a power window switch apparatus in accordance with the preamble of claim 1.

BACKGROUND OF THE INVENTION

In today's power window switch arrangements designers are striving to take into account the problem of providing power window switches, in particular power window switches for motor vehicles, where the switches are configured such that inadvertent closing of associated windows are prevented, this as inadvertent closing may cause accidents involving children.

Some previous attempts to provide such arrangements have been based on the utilization of an actuation element which is associated in a pushing direction for the downward motion of the window and in a pulling direction for the upward motion of the window, respectively, using a pivoting motion for the actuation element.

One such previous attempt is illustrated by U.S. Pat. No. 6,054,655, which describes a motor vehicle power window switch of the type in a housing and having a pivotally supported actuation element, which actuates switch contacts by means of a corresponding sliding contact element associated with connector contacts. The actuation element is associated in a pushing direction for the downward motion of the window and in a pulling direction for the upward motion of the window, respectively, with a two-stage pivoting motion. The actuation element acts on deflecting means to effect a linear back-and-forth motion of the sliding contact element, which successively actuates two switch contacts of a switch matrix in each direction.

However, as U.S. Pat. No. 6,054,655 relies on pivoting motion of the actuation element there remains the possibility of inadvertently tripping the actuation element such that upward motion of the window is triggered. Thus, although striving at increased safety, it relies on use of the unsafe pivoted toggle or rocker type switches that can be tripped by an occupant of the vehicle, with the potential for a moving window or panel to entrap an occupant as the result.

SUMMARY OF THE INVENTION

An object of the present invention is to provide an improved power window switch apparatus having a switch housing supporting at least one actuation element for user access at a first surface of said switch housing, through which switch apparatus the risk of effecting inadvertent lift of an associated window or panel is eliminated or at least reduced.

According to a first aspect of the present invention this object is achieved in accordance with the characterizing portion of claim 1, which specifies that said actuation element is arranged to be slideable from a zero position in directions perpendicular to said first surface; said actuation element being operable upon user manipulation to slide in a first direction outwards of said housing for closing of an associated first switch element for energizing an associated motor for lift of an associated window; said actuation element being operable upon user manipulation to slide in a second direction, opposite to said first direction, for closing of an associated second switch element for energizing said associated motor for lowering said associated window.

Further embodiments are listed in the dependent claims.

It will be appreciated that features of the invention are susceptible to being combined in any combination without departing from the scope of the invention as defined by the accompany claims.

BRIEF DESCRIPTION OF THE DRAWINGS

By way of example only, embodiments of the present invention will now be described with reference to the accompanying drawings wherein.

Figure 1:
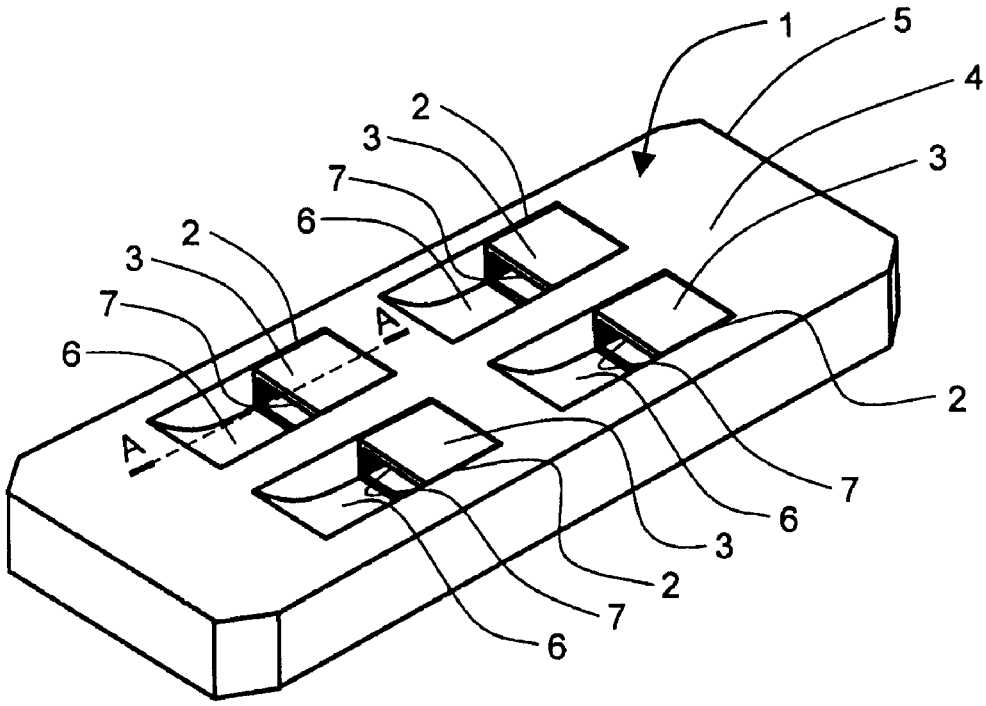
FIG. 1 is a perspective view of a first form of embodiment of the inventive power window switch apparatus.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein. The same reference numerals will be used for illustrating corresponding features in the different drawings.

DETAILED DESCRIPTION OF PREFERRED EMBODIMENTS

In a preferred first embodiment of the present invention, as shown schematically in FIG. 1, a motor vehicle power window switch apparatus for selectively energizing any one of four respective vehicle power window lifting and lowering motors is indicated generally at 1. The apparatus has four respective actuation elements 2, each with an operating surface 3 level with a first surface 4 of a housing 5. Switch housing 5 supports the actuation elements 2 for user access at the first surface 4 of the switch housing 5. Each respective actuation element 2 resides in a well indicated generally at 6 recessed in the housing 5 from the first surface 4. Each respective actuation element 2 is configured in such a manner that an operating portion 7 thereof can be accessed by reaching into the well 6. On its operating surface 3, actuation element 2 may be provided with symbols or translucent lenses (not illustrated), which may be backlit by (not illustrated) light-emitting elements.

Figure 2A:
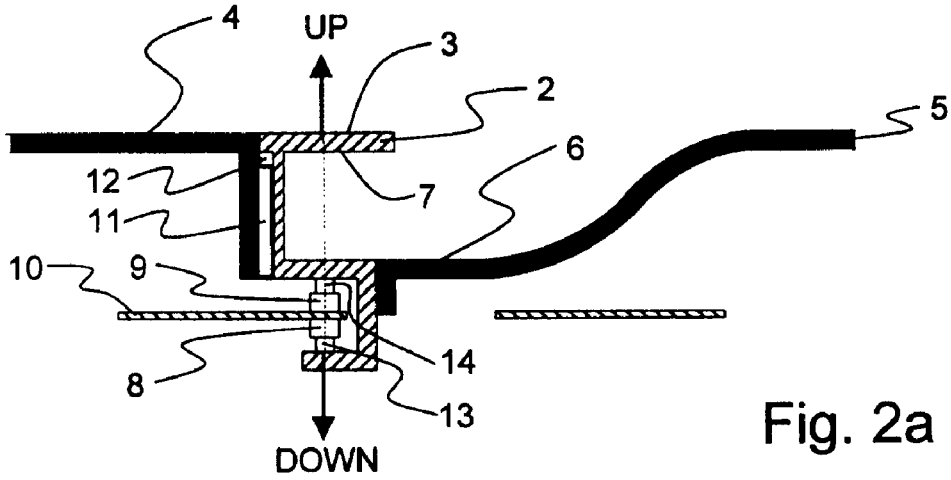
FIG. 2*a* is a sectional view of the power window switch apparatus of FIG. 1 along line A-A in a zero position.

As can be seen from FIG. 2*a*, which illustrates a sectional view of the power window switch apparatus of FIG. 1 along line A-A in a zero position, the actuation element 2 is arranged to be slideable from the zero position in directions perpendicular to the first surface 4, as illustrated by arrows indicated UP and DOWN. The actuation element 2 is operable upon user manipulation to slide in a first direction UP outwards of the housing 5 for dosing of an associated first switch element 8 for energizing an associated motor (not illustrated) for lift of an associated window or panel (not illustrated). Furthermore, the actuation element 2 is operable upon user manipulation to slide in a second direction DOWN, opposite to the first direction UP, for closing of an associated second switch element 9 for energizing the associated motor (not illustrated) for lowering the associated window or panel (not illustrated).

As mentioned above, the actuation element 2 resides in a well 6 recessed in the housing from the first surface 4 and has an operating surface 3 level with the first surface 4 of the housing 5 through which operating surface 3 an operator is enabled to manipulate the actuation element 2 to slide in the second direction DOWN, e.g. through pushing with a finger (not illustrated) at the operating surface 3 of the actuation element 2.

As also mentioned above, the actuation element 2 includes an operating portion 7, which is accessible through the well 6, through which operating portion 7 an operator is enabled to manipulate the actuation element 2 to slide in the first direction UP, e.g. through inserting a finger (not illustrated) into the operating portion 7 of the actuation element 2 and pulling the actuation element 2 in the first direction UP.

In the illustrated embodiment the first and second switch elements 8, 9 are of non-locking spring back push-down type and the actuating members thereof are arranged to be operated in the first and the second directions respectively in order to close the respective switch elements 8, 9 for energizing the associated motor (not illustrated). It will, however, be obvious to the person skilled in the art that other switch types may be used, whilst still relying on a linearly sliding actuation element 2.

In the illustrated embodiment the first and second switch modules are mounted to a respective side of an associated circuit board 10. The actuation element 2 is arranged to rest against the actuating members 13, 14 of the first and the second switch elements 8, 9 at a first and a second direction side in the zero position as illustrated in FIG. 2*a*.

Figure 2B:
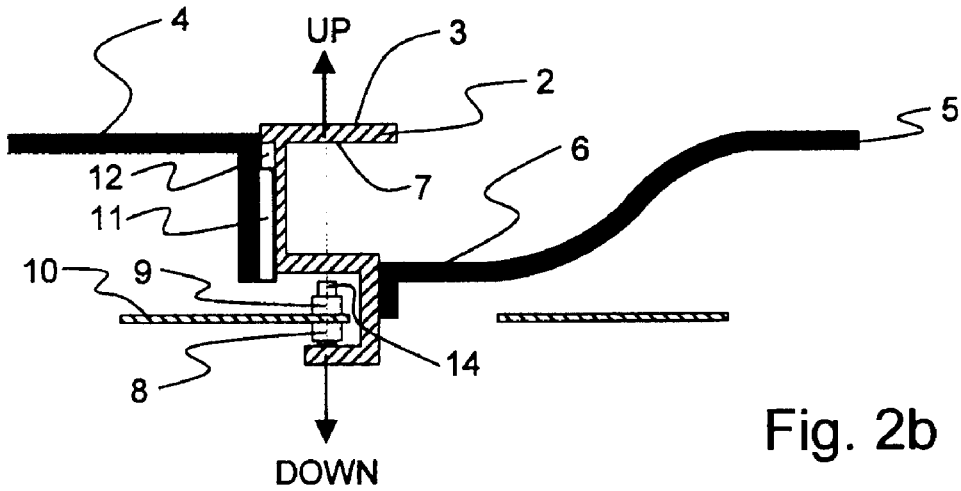
FIG. 2*b* is a sectional view of the power window switch apparatus of FIG. 1 along line A-A in a window lift position.
Figure 2C:
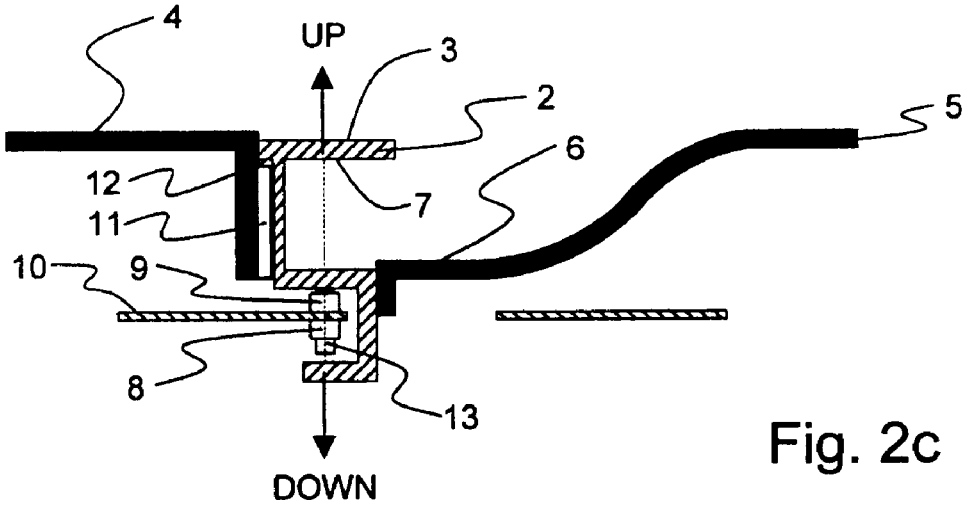
FIG. 2*c* is a sectional view of the power window switch apparatus of FIG. 1 along line A-A in a window lowering position.

A first stopper is provided for restricting sliding of the actuation element 2 in the first direction UP to a first predetermined position as illustrated in FIG. 2*b*, and a second stopper is provided for restricting sliding of the actuation element in the second direction to a second predetermined position as illustrated in FIG. 2*c*. These stoppers can, e.g. as shown be provided by the first and the second switch elements 8, 9 although separate stoppers (not illustrated) may be provided.

The switch housing 5 supports the actuation element 2 for sliding through the switch housing 5 and the actuation element 2 is provided with at least one set of complementary guide elements 11, 12. In one embodiment it is envisaged that each set of interacting guide elements comprises at least one guide rail 11 and a corresponding slide track 12 extending in a direction perpendicular to the first surface 4. Although only illustrated at one side in the sectional views of FIGS. 2*a*-2*c*, it is envisaged that guide elements be provided at multiple sides of the actuation elements 2, for ensuring smooth sliding thereof.

Thus, in accordance with the power window switch apparatus 1 as described herein inadvertent closing of the window is prevented because the actuation of the actuation element 2 in the first "pulling" direction UP must be carried out consciously and no inadvertent tripping is possible as the actuation elements 2 can not be actuated through toggling or rocking thereof.

In accordance with the present invention is also envisaged an automotive vehicle, which comprises a power window switch apparatus as described above.

Modifications to embodiments of the invention described in the foregoing are possible without departing from the scope of the invention as defined by the accompanying claims.

Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural and vice versa.

Numerals included within parentheses in the accompanying claims are intended to assist understanding of the claims and should not be construed in any way to limit subject matter claimed by these claims.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A power window switch apparatus (1) having a switch housing (5) supporting at least one actuation element (2) for user access at a first surface (4) of said switch housing (5), wherein said actuation element (2) is arranged to be slideable from a zero position in directions perpendicular to said first surface (4);

said actuation element (2) being operable upon user manipulation to slide in a first direction outwards of said housing (5) for closing of an associated first switch element (8) for energizing an associated motor for lift of an associated window; said actuation element (2) being operable upon user manipulation to slide in a second direction, opposite to said first direction, for closing of an associated second switch element (9) for energizing said associated motor for lowering said associated window, the first and second switch modules being mounted to respective first and second sides of an associated circuit board.

2. The power window switch apparatus (1) according to claim 1, wherein said actuation element (2) resides in a well (6) recessed in said housing (5) and has an operating surface (3) level with said first surface (4) of said housing (5) through which operating surface (3) an operator is enabled to manipulate said actuation element (2) to slide in said second direction.

3. The power window switch apparatus (1) according to claim 2, wherein said actuation element (2) includes an operating portion (7) accessible through said well (6) through which operating portion (7) an operator is enabled to manipulate said actuation element (2) to slide in said first direction.

4. The power window switch apparatus (1) according to claim 1 wherein said first (8) and second (9) switch elements are of non-locking spring back push-down type and actuating members (13, 14) thereof are arranged to be operated in said first and said second directions respectively.

5. The power window switch apparatus (1) according to claim 4, wherein said actuation element (2) is arranged to rest against said actuating members (13, 14) of said first (8) and said second (9) switch elements at a first and a second direction side in said zero position.

* * * * *